US007609176B2

(12) United States Patent
Yamane et al.

(10) Patent No.: US 7,609,176 B2
(45) Date of Patent: Oct. 27, 2009

(54) TRAFFIC INFORMATION PREDICTION APPARATUS

(75) Inventors: Kenichiro Yamane, Tokyo (JP); Yoshinori Endo, Zama (JP); Kimiyoshi Machii, Tokyo (JP); Junsuke Fujiwara, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/053,902

(22) Filed: Feb. 10, 2005

(65) Prior Publication Data

US 2005/0206534 A1 Sep. 22, 2005

(30) Foreign Application Priority Data

Feb. 27, 2004 (JP) ..... 2004-053548

(51) Int. Cl.
*G08G 1/123* (2006.01)

(52) U.S. Cl. ..... 340/994; 340/988; 340/989; 701/209; 701/210

(58) Field of Classification Search ..... 340/994, 340/988, 989; 701/209, 210, 117, 25, 26
See application file for complete search history.

(56) References Cited

U.S. PATENT DOCUMENTS 6,314,368 B1 * 11/2001 Gurmu et al. ..... 701/209
6,563,433 B2 * 5/2003 Fujiwara ..... 340/988
6,922,629 B2 * 7/2005 Yoshikawa et al. ..... 701/117

FOREIGN PATENT DOCUMENTS

JP 10-89977 A 4/1998
JP 2002-0516898 A 6/2002
JP 2004-20288 A 1/2004

OTHER PUBLICATIONS

Japanese office action dated Feb. 27, 2009.

* cited by examiner

*Primary Examiner*—Daryl Pope
(74) *Attorney, Agent, or Firm*—Crowell & Moring LLP

(57) ABSTRACT

A traffic information prediction system, including a traffic information prediction apparatus, of the present invention comprises travel status measuring means for measuring a travel status of a vehicle and accumulating it as travel record information, and traffic information predicting means for predicting traffic information on a route on the basis of the travel record information and statistical traffic information to predict an arrival time to any place on a route containing the destination. The traffic information predicting means compares a traveling trace based on the statistical traffic information and the traveling trace based on the travel record information to calculate the degree of progress of the travel record based on the statistical traffic information, and correct the traveling trace based on the statistical traffic information on the basis of the degree of progress.

8 Claims, 10 Drawing Sheets

FIG. 2

| | | | |
|---|---|---|---|
| Secondary Mesh Information Number | | | |
| Secondary Mesh Information | Secondary Mesh Information Size | | |
| | Secondary Mesh Code | | |
| | Information Links Number In Secondary Mesh | | |
| | Link Information | Link Layer | |
| | | Link Section | |
| | | Link Number | |
| | | Main Route | Route Number |
| | | | Road Type Code |
| | | Important Route | Route Number |
| | | | Road Type Code |
| | | Link Length | |
| | | Restraint Speed | |
| | | Link Type Code | |
| | | Link Advancement Direction | |
| | | Road Width Section Code | |
| | | Main Cross - Point Flag | Link Start Point |
| | | | Link Terminal Point |
| | | Start Point Coordinate | X Coordinate |
| | | | Y Coordinate |
| | | Terminal Point Coordinate | X Coordinate |
| | | | Y Coordinate |
| | | Connection Link Information | Pointer To Connection Link 1 |
| | | | Pointer To Connection Link 2 |
| | | | Pointer To Connection Link 3 |
| | | | Pointer To Connection Link 4 |
| | | | Pointer To Connection Link 5 |
| | | | Pointer To Connection Link 6 |
| | | Link Cost | Link Cost 1 |
| | | | Link Cost 2 |
| | | | Link Cost 3 |

FIG. 3

| User ID | |
|---|---|
| Position Information 1 | Latitude |
| | Longitude |
| | Passing Time |
| | Speed |
| Position Information 2 | Latitude |
| | Longitude |
| | Passing Time |
| | Speed |
| ⋮ | ⋮ |
| Position Information n | Latitude |
| | Longitude |
| | Passing Time |
| | Speed |

FIG. 4

| User ID | |
|---|---|
| Link Information 1 | Secondary Mesh Code |
| | Link Section |
| | Link Number |
| | Start Point Passing Time |
| | Terminal Point Passing Time |
| | Link Travel Time |
| Link Information 2 | Secondary Mesh Code |
| | Link Section |
| | Link Number |
| | Start Point Passing Time |
| | Terminal Point Passing Time |
| | Link Travel Time |
| ⋮ | ⋮ |
| Link Information 2 | Secondary Mesh Code |
| | Link Section |
| | Link Number |
| | Start Point Passing Time |
| | Terminal Point Passing Time |
| | Link Travel Time |

FIG. 5

<table>
<tr><td rowspan="8">Header Portion</td><td colspan="4">Data Size</td></tr>
<tr><td colspan="4">Traffic Information Start Day</td></tr>
<tr><td colspan="4">Traffic Information End Day</td></tr>
<tr><td colspan="4">Vics Link Version</td></tr>
<tr><td colspan="4">Data Type</td></tr>
<tr><td colspan="4">Data Category</td></tr>
<tr><td colspan="4">Time Unit</td></tr>
<tr><td colspan="4">Time Unit</td></tr>
<tr><td rowspan="12">Data Portion</td><td colspan="4">Secondary Mesh Information</td></tr>
<tr><td rowspan="11">Secondary Mesh Information</td><td colspan="3">Secondary Mesh Information Size</td></tr>
<tr><td colspan="3">Average Speed In Secondary Mesh (Express Highway)</td></tr>
<tr><td colspan="3">Average Speed In Secondary Mesh (General Road)</td></tr>
<tr><td colspan="3">Secondary Mesh Code</td></tr>
<tr><td colspan="3">Information Links Number In Secondary Mesh</td></tr>
<tr><td rowspan="7">Link Information</td><td colspan="2">Link Layer</td></tr>
<tr><td colspan="2">Link Section</td></tr>
<tr><td colspan="2">Link Number</td></tr>
<tr><td rowspan="4">Time Zone Information</td><td>Statistical Travel Time</td></tr>
<tr><td>Traffic Jam Degree</td></tr>
<tr><td>Traffic Jam Length</td></tr>
<tr><td>Reliability</td></tr>
</table>

FIG. 6

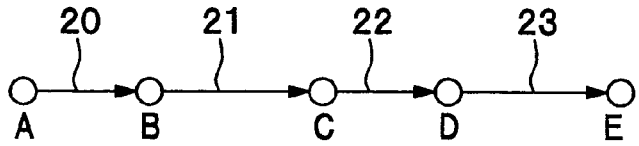

FIG. 7

| Link Number | Link Length (m) | Statistical Travel Speed (Km/h) | | | |
|---|---|---|---|---|---|
| | | 10:00 | 10:05 | 10:10 | 10:15 |
| 20 | 600 | 30 | 25 | 20 | 15 |
| 21 | 1000 | 25 | 20 | 25 | 30 |
| 22 | 800 | 35 | 30 | 20 | 40 |
| 23 | 1200 | 25 | 15 | 10 | 20 |

TRAFFIC INFORMATION PREDICTION APPARATUS

FIELD OF INVENTION

The present invention relates to a traffic information prediction system, more specifically, a prediction system which includes in-situ traffic information prediction apparatus (abbreviated as a traffic information prediction apparatus) for providing most-likely predicted arrival time by predicting a travel time (necessary time) to a destination.

A car navigation device for receiving real-time traffic information such as a traffic jam, travel time, etc., from a VICS (Vehicle Information and Communication System) center through FM multiplex broadcasting, radio wave beacon or the like and integrating the traffic information thus received to display a predicted arrival time is known as a conventional traffic information prediction apparatus for providing a predicted arrival time at the destination. However, the car navigation device using the VICS traffic information has the following two problems. The first problem resides in that the traffic information of VICS suffers severe time-sequential variation because of influence of traffic signals and characteristics of measurement information obtained by on-road sensors and also reliability (precision) cannot be necessarily kept because of mistakes of setting at an information supply side or the like. A second problem resides in that the traffic information of VICS is present (real-time) information and thus there would be no problem if the traffic condition is continued until a user arrives at the destination, however, reliability of the predicted arrival time becomes less because the traffic condition is generally varied at every time and moment.

For the above problem, it is needed to carry out near-future prediction, not on the basis of the traffic information of VICS, but on the basis of measurement information obtained by actually running vehicles (probe car data). In a traffic condition estimating method using probe information and a traffic condition estimating/providing system disclosed in the following patent document 1, probe car data measured by probe cars is collected at a traffic information center and the center makes a prediction by using the probe car data in accordance with a request from a user and supplies the prediction result to the user.

Patent Document 1:

Japanese Laid-Opened Patent Application, 2002-251698

However, the prediction technique based on the probe car data described above has the following problem. In order to cover all the roads across the country by probe cars, at least several tens of thousands of probe cars are required to run at the same time. However, this is applied to only an association experiment phase and thus it has not yet been practically used. In consideration of this situation, the technique described above cannot be used in the foreseeable future. Furthermore, with respect to management of information of many probe cars, the data amount thereof is vast, and this induces a problem in cost of facilities of the center. Furthermore, privacy protection is also an important problem in addition to the introducing cost of in-vehicle devices mounted in probe cars and the communication cost for notifying position information. Still furthermore, according to the probe car system, probe car data which were measured in the past by other drivers are collected and supplied to a different driver. Therefore, the running characteristics of the driver to which the probe car data are supplied (i.e., runs in a rapid velocity, runs at a slow velocity or the like) cannot be considered, and thus the precision of probe car data under such an environment that a vehicle can run relatively freely, particularly when a plurality of traffic lanes are provided on a road or there is no traffic jam on a road is not necessarily good.

The present invention has been implemented in view of the foregoing situation, and has an object to provide a traffic information prediction apparatus which can accurately predict a travel time to a destination, and supply information on a highly reliable predicted arrival time.

SUMMARY OF THE INVENTION

In order to attain the above objects, a traffic information prediction apparatus according to the present invention has a construction which has statistical traffic information created in advance on the basis of various kinds of traffic information such as VICS, probe car data, etc., and can accurately estimate a travel time to a destination by using measurement information obtained under running of a vehicle and the statistical traffic information, and also supply a highly reliable predicted arrival time. Specifically, it comprises running state measuring means for measuring a running state of a vehicle and accumulating the running state of the vehicle thus measured as running record information, and traffic information predicting means for predicting traffic information on a route on the basis of the running record information and the statistical traffic information to predict an arrival time at any place on the route containing the destination. The traffic information predicting means compares a travel locus based on the statistical traffic information and a traveling trace based on the running record information to determine the degree of the running recording progress to the statistical traffic information and correct the traveling trace based on the statistical traffic information on the basis of the degree of progress, thereby predicting the traffic information.

In addition to the above configuration, the traffic information prediction apparatus of the present invention may be further equipped with means for carrying out transmission/reception of data to/from the outside, route searching means for searching a route to a destination and prediction result outputting means for outputting a prediction result. Accordingly, if the degree of progress is out of a predetermined range in the traffic information predicting means, this fact is notified to a user to make the user input whether the user obtains traffic information from an outside institution such as a traffic information center or the like to re-search a route. If it is determined to carry out the re-search, traffic information is downloaded from the outside institution, and the route is re-searched by using the traffic information in the route searching means.

According to the present invention, the travel time necessary to arrive at the destination can be accurately predicted by providing the statistical traffic information which is created in advance on the basis of the various traffic information such as VICS, the probe information, etc., and using the measurement information obtained under the running of the vehicle itself, and the statistical traffic information. Accordingly, the highly reliable predicted arrival time can be supplied to the driver.

Furthermore, according to the present invention, even when the progress condition to the arrival prediction based on the original statistical data is greatly different, the user is prompted to re-search a route. Therefore, the re-search is carried out only as needed and the real-time traffic information can be obtained, so that the user's operation amount and the cost needed for the data communication can be suppressed to the minimum level and convenience can be improved.

BRIEF DESCRIPTION OF THE DRAWINGS

FIG. 2 shows an example of the construction of a map data base.

FIG. 3 shows an example of the construction when measurement/compilation is carried out for every vehicle position as an example of the running record.

FIG. 4 shows an example of the construction when measurement/compilation is carried out for every link as an example of the running record.

FIG. 5 shows an example of the construction of a statistical traffic information data base.

FIG. 6 is a diagram showing an example of a road network used to describe calculation of a travel time on a route.

FIG. 7 shows an example of a time-based statistical travel speed of each link in the road network of FIG. 6.

DETAILED DISCRIPTION OF THE INVENTION

Figure 1:
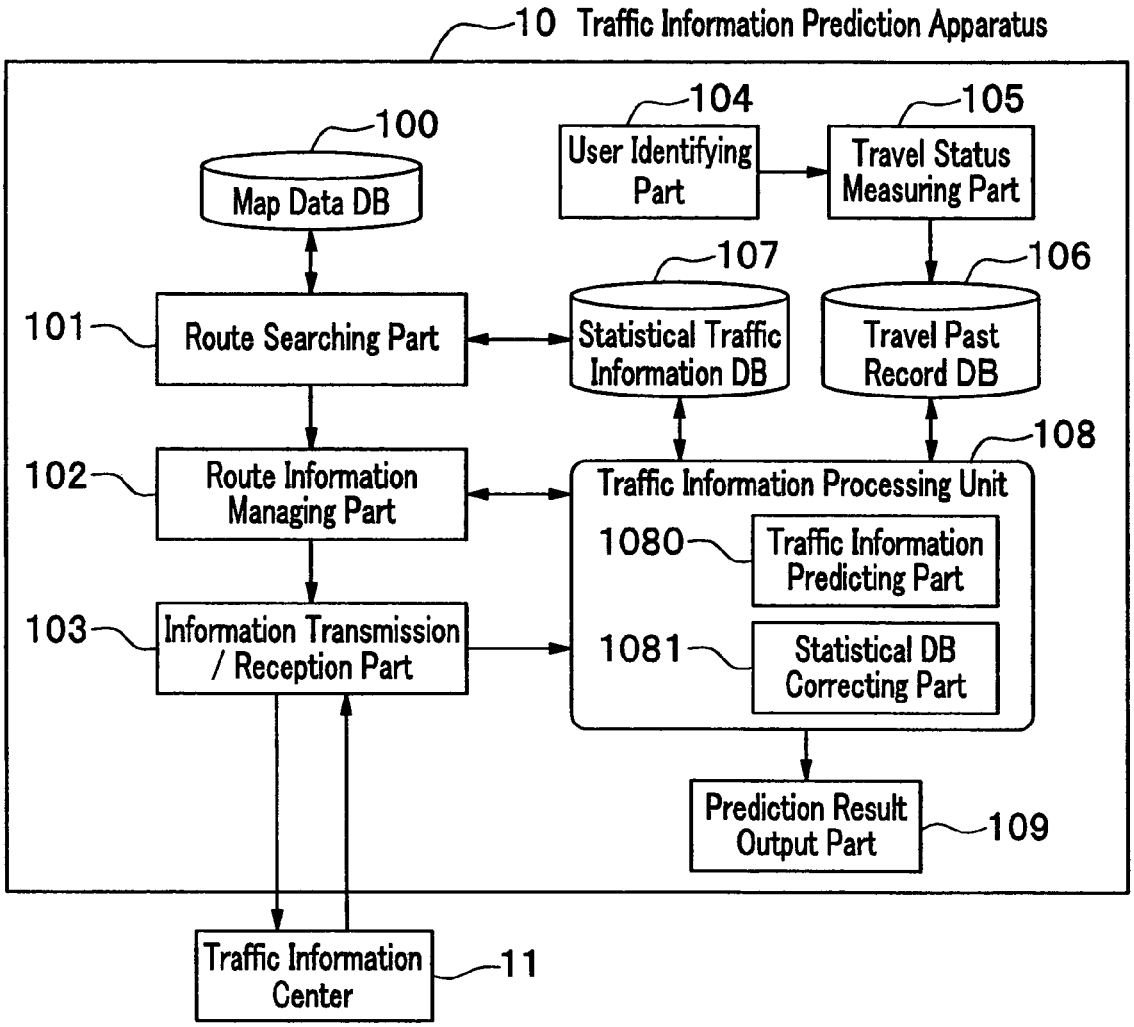
FIG. 1 is a diagram showing an example of the construction of a traffic information prediction apparatus.

Next, a traffic information prediction apparatus according to the present invention will be described in detail. FIG. 1 is a diagram showing the total system construction of the traffic information prediction apparatus of the present invention.

The traffic information prediction apparatus 10 regarding the present invention comprises a map data base. (abbreviated as "DB") 100, a route searching part 101, a route information managing part 102, an information transmitting/receiving unit 103, a user identifying part 104, a running state measuring unit 105, a running record DB 106, a statistical traffic information DB 407, a traffic information processing unit 108 and a prediction result outputting unit 109. Furthermore, the traffic information processing unit 108 comprises a traffic information predicting part 1080 and a statistical DB correcting part 1081. The traffic information prediction apparatus 10 is an in-vehicle mounted terminal or portable terminal which is equipped with a car navigation device or a device having the same function as the car navigation such as a laptop personal computer, a PDA, a cellular phone terminal or the like, and it calculates a route by using the map DB 100 and the statistical traffic information DB 107 which are equipped in advance, predicts a travel time to a destination by using the statistical traffic information DB 107 and the running record DB 106 which has been accumulated until then with respect to the route, and outputs the predicted arrival time or the like. If necessary, the traffic information prediction apparatus 10 may access an outside traffic information center 11 to obtain real-time traffic information and predict the arrival time.

Next, the function of each unit constituting the present invention will be described.

The map DB 100 is used by each of the applications for map drawing, route searching, guidance, etc., and an example of the construction thereof is shown in FIG. 2. The road data are basically managed on a link basis. Connection link information and link costs are mainly used for the route searching. In the latter are stored a distance, an expense for a toll road, a travel time, the width of a road, a road type such as a national road/prefectural road or the like, a link weight corresponding to whether a signal cross-point is contained or not.

On the basis of the position information of a destination indicated by the user, the route searching part 101 determines as an optimal route a travel route from the current place to the destination by using the connection link information and the link costs in the map DB 100 so that the sum of the link costs is minimized. Normally, a departure place is automatically determined from the position information of the current place obtained by GPS (Global Positioning System). However, any place on the map screen may be selected as a departure place by the user or the departure place may be selected/indicated from a list of famous places which are set in advance. Furthermore, the user may select preferential link costs in advance to obtain his/her favorite route. For example, it may be selected from preset menus such as preference of toll roads, preference of national roads, preference of time (shortest time), etc. Alternatively, three routes may be simultaneously determined/output according to the above three kinds of preference without the user's selection of preferential link cost by a user.

The route information managing part 102 stores and manages various information regarding the route which is determined in the route searching part 101 and which is selected by the user. Describing examples of information to be managed, there exists user ID, departure place/destination information, departure time, predicted travel time information at the departure time point, route link information, position information of check points, predicted passage times of the check points, etc. This route information is transmitted from the information transmission/reception part 103 to the outside traffic information center 11 and registered in the outside traffic information center 11. The traffic information center 11 may monitor the traffic condition on the route periodically, for example, every five minutes and when unforeseen trouble such as a traffic accident or a disaster occurs, it may notify the content of the trouble to the user. With respect to the management information, it may be deleted when the user arrives at the destination or at the timing when a predetermined time elapses.

The information transmission/reception part 103 has a function of transmitting/receiving data to/from the outside traffic information center 11. Specifically, it contains a communication adapter of various mobile communications such as a cellular phone, PHS (Personal Handyphone System), Bluetooth, wireless LAN or a dedicated communication unit for DSRC (Dedicated Short Range Communication) such as ETC or VICS. The route information or information on the type and area of information which the user wants to obtain is transmitted from the traffic information prediction apparatus 10 to the traffic information center 11, and the route information, the real-time traffic information corresponding to the area and statistical traffic information, etc., are transmitted from the traffic information center 11 to the traffic information prediction apparatus 10.

The user identifying part 104 identifies the driver (user) of the vehicle. It is used to specify a user and collect data (running record DB 106) measured in the running state measuring unit 105 on a user basis when one vehicle (traffic information prediction apparatus) is shared and used by a plurality of users. As the user identifying means, user ID may be identified by pressing any one of the buttons corresponding to a plurality of user IDs in the traffic information prediction apparatus 10 just before the operation is started (a plurality of a user IDs are allocated to respective users in advance), or information of a memory card in which authentication information containing user ID is stored may be read out through a memory card slot or the like which is equipped to the traffic information prediction apparatus 10 to identify the user, or user-identifiable information ID out of information owned at the vehicle side such as set information ID of each user such as a seat position of a driving seat, an electronic key, a license or the like may be read out by the traffic information prediction apparatus 10 to automatically identify the user. When the vehicle starts to run without any user-identifiable information, preset default user ID may be set. When there is only one user, the above function makes it unnecessary to input information for user identification.

The running state measuring unit 105 periodically measures the real-time running state, and accumulates the measured information in the running record DB. A specific example of the information thus measured is shown in FIG. 3 and FIG. 4. When these are accumulated, they correspond to the running record DB 106. FIG. 3 shows an example of measurement/compilation of velocity information every position of the vehicle, and the velocity information is measured/compiled at a fixed period such as every minute or every fixed distance such as every 100 meters. FIG. 4 shows an example of measurement/compilation of travel time information every link along the route; and the travel time information is measured/compiled every link on the route. The position information of the vehicle or the link information is generally obtained from GPS information. However, highly precise information can be obtained on the basis of the information of the map DB 100 by using a map matching technique or using information of an additive sensor of a gyro sensor or the like in combination. The velocity information of FIG. 3 can be obtained from the GPS information described above or vehicle velocity pulse information of the vehicle, and a link travel time can be estimated by applying the link length of the map DB 100 to this velocity information. The link travel time of FIG. 4 obtains the passage times at the link start/end points (obtained from the GPS information) through the map matching on the basis of the position information based on the GPS information or the like and the information of the map DB 100, and the difference between the passage times can be obtained as the link travel time.

The statistical traffic information DB 107 is subjected to statistical processing such as abnormal value removing processing, averaging processing, etc., based on accumulated past VICS traffic information and probe information and it reproduces a daily traffic condition. The DB may be classified into a plurality of parts in accordance with a combination of a day type such as a weekday or holiday, season, weather, etc. The statistical traffic information DB is created by the outside traffic information center 11 or the like which collects the above traffic information source data. Normally, the statistical traffic information DB is stored in a storage medium such as each kind of DVD media, a hard disk, a flash memory, each kind of memory card or the like, and it can be used for route searching and traffic information prediction by reading it out from the storage medium by the traffic information prediction apparatus 10. The statistical traffic information DB is periodically (every month, every season, every year or the like) renewed in connection with the time-variation of the traffic condition, and thus the DB may be obtained through data communications from the traffic information center 11 through the information transmission/reception part 103 by the traffic information prediction apparatus 10. FIG. 5 shows an example of data structure. The data are managed on a link basis (VICS link in this embodiment) and they are also managed on a time basis. When the time unit of the header portion is 5 (minutes) time zone information of the data portion is stored by repeating the link information at 288 times (first denotes information of 0:00, second denotes information of 0:05, . . . , 288th denotes information of 23:55), when the time unit is 60 (minutes), time zone information is stored by repeating the link information 24 times (first denotes information of 1:00, . . . , second denotes information of 1:00, and 24th denotes information of 23:00).

The traffic information processing unit 108 comprises a traffic information predicting part 1080 and a statistical DB correcting part 1081, and it predicts the traffic information and corrects the statistical traffic information DB 107. Next, the function of the respective parts constituting the unit and the processing flow will be described.

Figure 8:
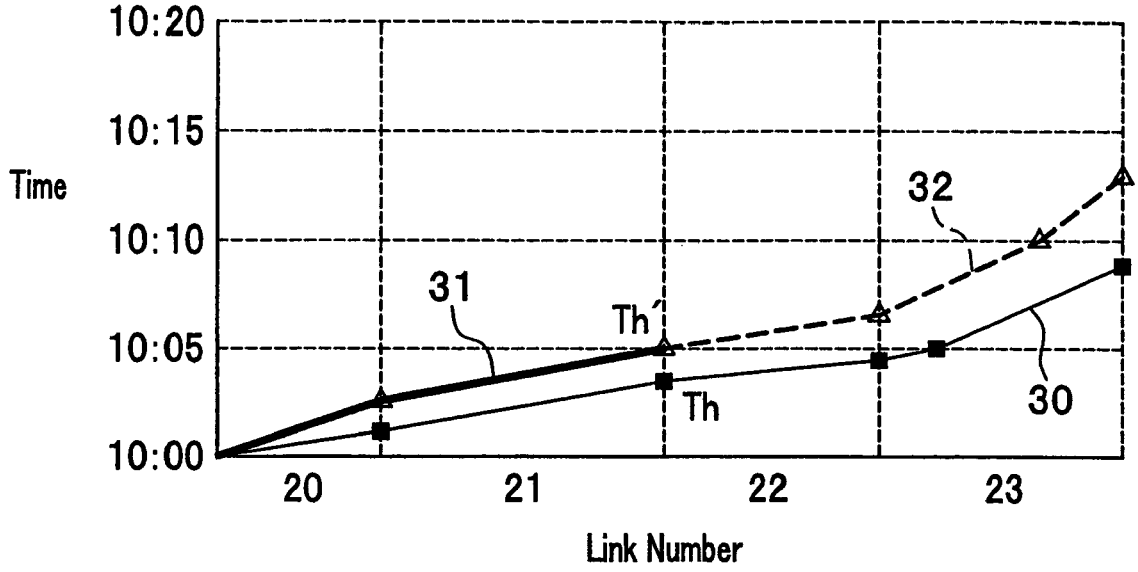
FIG. 8 is a diagram showing an example of a traveling trace calculated on the basis of the time-based statistical travel speed of FIG. 7 and a traveling trace calculated on the basis of predicted data.

The traffic information predicting part 1080 has a function of predicting a route to a destination and a traffic condition around the vehicle by using the running record DB 106 and the statistical traffic information DB 107. For example, the prediction processing when the route to the destination is set will be described with reference to FIG. 6 to FIG. 9. A case of FIG. 6 is considered as a simple example of a road network. A to E of FIG. 6 denote end points (called nodes) of links, and 20 to 23 denote links. The respective data such as the link length of each link and a statistical travel speed calculated from a statistical travel time every time zone are assumed to be set as shown in FIG. 7. The statistical travel time at 10:00 in FIG. 7 means a statistical travel speed at a time which is above 10:00 and less than 10:05. In this embodiment, a travel time from the node A to the node E is first predicted by using the statistical traffic information shown in FIG. 7 to calculate a predicted arrival time. When the vehicle departures from the node A at the time of 10:00:00, it is predicted that it needs 72 seconds (average speed is 30 km/h)$_3$ to pass through the link 20. The time has not yet reached 10:05 at the time point 10:01:12 at which the vehicle will arrive at the start point (node B) of the next link 21, and thus 25 km/h at 10:00 is selected as the predicted travel velocity of the link 21. Therefore, the travel time necessary to pass through the link 21 is equal to 144 seconds, and the total travel time from the node A is equal to 216 seconds (10:03:36). Likewise, the travel time necessary to pass through the link 22 is calculated as 82 seconds (total 298 seconds, 10:04:58). The travel time necessary to pass through the final link 23 is equal to 173 seconds (total 471 seconds, 10:07:51), and thus it is necessary to switch the velocity to the velocity of 10:05 on the way. That is, the velocity of 10:00 (25 km/h) is selected for the first 2 seconds after entering the link 23, and thus the travel distance during that time is substantially equal to 14 m. Thereafter, the velocity of 10:05 (15 km/h) is selected for the remaining distance 1186 m, and thus substantially 285 seconds is calculated as a needed time. Finally, the travel time necessary to pass through the link 23 is calculated as 287 seconds (total 585 seconds, 10:09:45). From the above result, the predicted arrival time at which the vehicle departing from the node A at 10:00:00 arrives at the node E is calculated as 10:09:45, and the traveling trace of the overall route is indicated by a graph 30 of FIG. 8. The predicted arrival time to arrive at a desired destination on the way to the destination can be calculated by using the statistical traffic information DB 107 according to the manner as described above. However, in the traffic information predicting part 1080, the above prediction calculation is carried out by further using past running record data (using the running record DB 106) in combination to correct the predicted arrival time. For example, it is assumed that the vehicle departing from the node A at 10:00:00 arrives at the node C at 10:05:00 with the node E set as the destination like the above-described example (the traveling trace corresponds to a graph 31)). At that time point (actually-recorded travel time Th'=300 seconds, 10:05:00), the predicted arrival time to the node C based on the statistical traffic information DB base 107 is equal to 10:03:36 (statistical travel time Th=216 seconds). Therefore, it is calculated that the vehicle arrives at the node C with a delay of one minute and twenty-four seconds (39%) with respect to the statistical travel time Th. This delay (in some cases, it is not delayed, but advanced) will be referred to as the "degree of progress." The degree of progress is represented by the difference or ratio between the predicted arrival time (statistical travel time) and the actually-recorded travel time). Furthermore, the degree of progress is regarded as a result of the composite action between two factors that the actual traffic condition is more congested as compared with the estimation and that the driver drives his/her car more comfortably as compared with the statistical driver's driving characteristic, and the travel time based on the statistical traffic information DB 107 is corrected by the following method on the assumption that the degree of progress described above is continued until the destination. When the destination is far and a long travel time is needed, it may be considered that the prediction precision is deteriorated because the prediction must be carried out in the remote future. In this case, it may be adopted that the following prediction is carried out from the current time (or departure scheduled time) to a predetermined near future time (for example, until two hours elapse), and then the statistical travel time data described above is used in a move remote future with no prediction. In place of the predetermined near future time, a predetermined distance (for example, until 200 km) from the current place (departure place) may be used as a prediction target as described above.

Figure 9:
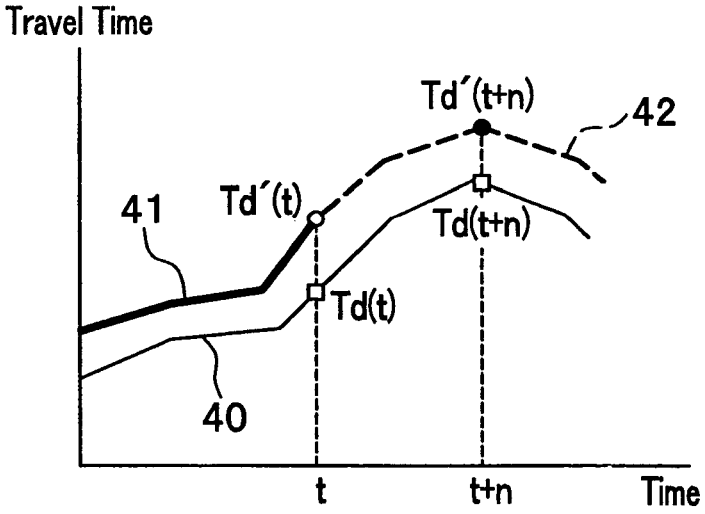
FIG. 9 is a diagram showing a prediction processing method.

In FIG. 9, reference numeral 40 denotes a statistical travel time transition about links to be predicted (in this embodiment, the links 22 and 23 of FIG. 8), and it is obtained by referring to the statistical traffic information DB 107. The variable "t" denotes a current time on a current day of prediction, and in the above embodiment, it corresponds to 10:05:00. Reference numeral 41 denotes an actually-recorded travel time transition about the links until the current time t of the prediction current day. In the traffic information prediction apparatus 10, it cannot be known unless it is obtained from the traffic information center 11 through communications, and there is no problem even if this information is not obtained. The information to be predicted at present is a travel time (predicted travel time) 42 in the near future subsequent to the current time t. In order to calculate a travel time Td' (t+n) of the time (t+n) corresponding to a future time of n period at the current time t, the statistical travel time Td(t+n) at the time (t+n) and the degree of progress which corresponds to the ratio of the actually-recorded travel time Th' in the past running record and the statistical travel time Th are applied to the following equation.

$$Td'(t+n)=Td(t+n)\times\gamma\times Th'/Th \quad (1)$$

Here, γ denotes a coefficient, and it is normally set to 1. However, when the prediction value and the past statistical value are not matched with each other, for example, when the degree of progress (Th'/Th) is larger than a normal range, the coefficient γ may be set to be smaller than 1 in accordance with the degree of progress, or conversely the coefficient γ may be set to be larger than 1 in accordance with the degree of progress when the prediction value and the past statistical value are not matched with each other, for example, when the degree of progress is smaller than the normal range, thereby correcting the value of (γ×Th'/Th1) so that the value is near to 1 (for example, the value of (γ×Th'/Th1) is not corrected so as to step over "1" like if γ×Th'/Th1 is equal to 1.2, the value is set to 1.1, and if γ×Th'/Th1 is equal to 0.8, the value is set to 0.9). Or, when a link and a time as prediction targets are considerably far and in the future (for example, a place which is far by 150 km or more or a time after two or more hours elapse) as compared with the current place and the present time, the prediction precision may be lowered, and thus the value of γ×Th'/Th1 is corrected so that it approaches 1 in accordance with the distance or the arrival time. Or, the statistical data is used (γ×Th'/Th1 is set to 1) without any prediction target because high prediction precision is unexpected. That is, attention is dynamically paid so that the predicted travel time to be determined is not a unique value. Or, the actually-recorded travel time and the statistical traffic jam condition and the number of traffic lanes in the prediction target link are considered, and when during the actually-recording time the driver is under a free running state where he/she can freely pass surrounding cars, however, the prediction target link is under a non-free running state (when traffic jam occurs or the number of traffic lanes is equal to 1), the value of (γ×Th'/Th1) is corrected so as to approach 1 in accordance with the degree of freedom of running and then the prediction is made, or the statistical data may be used without any prediction target. Conversely, when the non-free running state is set at the actually-recording state, however, the prediction target link is under the free running state, the value of (γ×Th'Th1) may be corrected in accordance with the degree of freedom of the running so that it is far from 1 (for example, the value of (γ×Th'/Th1) does not exceed 1 like if γ×Th'/Th1 is equal to 1.2, it is corrected to 1.3, and if γ×Th'/Th1 is equal to 0.8, it is corrected to 0.7), and the statistical data are used without prediction, or the prediction may be carried out by using a driver's past average degree of progress under the freely running state. Furthermore, the unique value as described above is not used as the degree of progress at the actually-recording time, but different values may be calculated for the freely running state and the non-freely running state respectively, and the prediction may be carried out by using the degree of progress corresponding to each state of the prediction target link. In this case, when the same running state at the prediction time does not exist under the actually-recording state, the value of (γ×Th'/Th1) may be corrected.

In the case of the above equation, the statistical travel time Td (t+n) of the time (t+n) to be predicted is corrected by using as the degree of progress the ratio of the actually-recorded travel time Th' in the past travel record and the statistical travel time Th, however, the statistical travel time Td (t+n) may corrected by using the difference between the actually-recorded travel time Th' and the statistical travel time Th as the degree of progress according to the following equation.

$$Td'(t+n)=Td(t+n)+d\times(Th'-Th) \quad (2)$$

Here, d denotes a coefficient. As in the case of the coefficient γ, the coefficient d may be normally set to 1. However, dynamic consideration may be paid so that the predicted travel time to be calculated is not equal to a unique value by setting the coefficient d to be larger than 1 in accordance with the degree of progress (Th'−Th) or using the statistical data with no prediction target because high prediction precision is unexpected.

In the above example, the prediction at the time (t+n) corresponding to a future time of n period with respect to the current time t is described. If n is incremented like 0, 1, 2, 3, . . . to calculate Td'(t+n), the future prediction values whose number corresponds to the above increment amount can be obtained. After the above prediction processing is applied to all the prediction target links on the route, the traveling trace 32 based on the prediction data may be determined as in the case of the determination of the traveling trace based on the statistical data indicated by the graph 30 in FIG. 8 to obtain a predicted arrival time.

Figure 10:
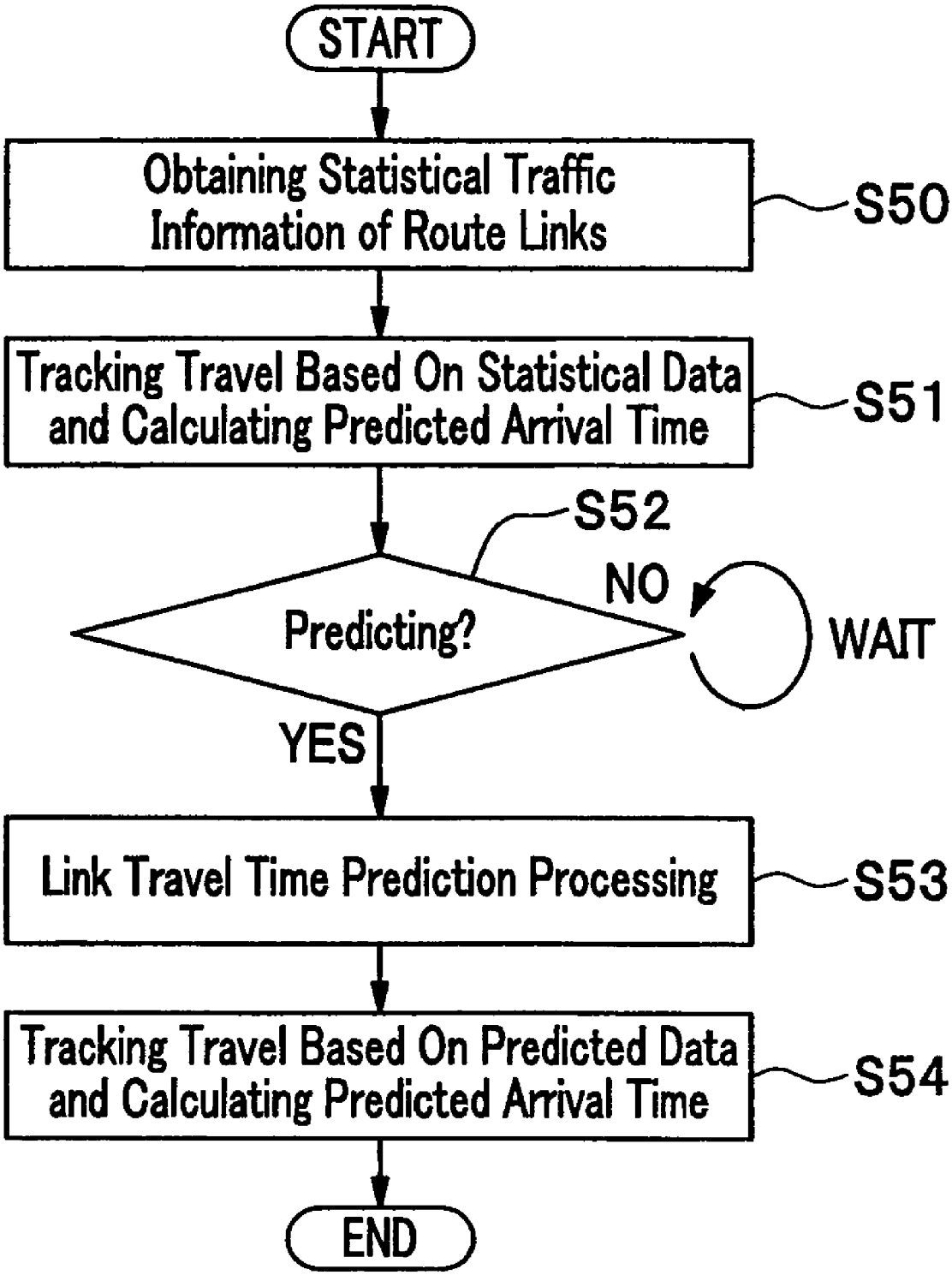
FIG. 10 is a flow chart showing an example of the prediction processing in a traffic information predicting part.

The processing flow of the traffic information predicting part 1080 described above will be specifically described with reference to the flow chart of FIG. 10. First, data on all the links contained in the route set in the route information managing part 102 are obtained from the statistical traffic information DB 107 (S50), and the traveling trace based on the statistical data like the graph 30 of FIG. 8 and the predicted arrival time are calculated (S51). Then it is judged whether the prediction processing should be carried out or not during running (S52). The prediction processing of S52 may be started under such a condition as every fixed period (every 5 minutes, every 30 minutes or the like), every fixed distance (every 10 Km or the like), every link passage, every main cross-point passage or the like, and this condition is preset in the traffic information prediction apparatus 10. Furthermore, the condition may be altered in accordance with the user's desires. When the prediction is carried out (YES in S52), at the time point t when the prediction processing is started, the degree of progress based on the statistical travel time is calculated as in the case of the travel time Th' based on the running record, and the near future travel time prediction value of each link is calculated by (equation 1) or (equation 2) (S53). Finally, as in the case of S51, the traveling trace based on the prediction data and the predicted arrival time to the destination are calculated (S54).

The predicted arrival time to any place containing the destination on the route can be calculated in the manner described above. If any places around the vehicle are set as destinations and the same prediction as described above is carried out on a route to each of the destinations by applying the above function, predicted arrival times to any places containing the respective destinations around the vehicle can be obtained.

The statistical DB correcting part 1081 has a function of amending/correcting the existing statistical traffic information DB 107 on the basis of the past accumulated travel record DB 106 or the statistical traffic information received from the traffic information center 11. As an example of the amendment/correction of the statistical traffic information DB 107 based on the past accumulated travel record DB 106, for example, when the user departs at a predetermined time along a predetermined route such as a commute route, a school route or the like, an abundance of running record data can be collected and compiled. Therefore, information having higher quality than the originally stored statistical traffic information DB 107 can be created by the statistical processing of the record data (abnormal data removal, averaging, etc.), and thus the statistical traffic information dB 107 may be replaced by the statistical traffic information based on this running record. The statistical traffic information based on this running record is obtained as a result of contributions of the user's driving characteristics, and thus it may be managed on a user basis. When the statistical traffic information DB 107 is partially replaced, it is more effective for saving of the data amount and restoration of the data that the statistic traffic information DB 107 is managed as differential information every user, and the differential information may be stored as a part of the statistical traffic information DB 107 in each of various kinds of storage media such as the various kinds of rewritable DVDs, hard disk drives, various kinds of memory cards, etc. On the other hand, with respect to the amendment/correction of the statistical traffic information DB 107 based on the statistical traffic information received from the traffic information center 11, it denotes a daily traffic condition as in the case of the existing statistical traffic information DB 107, and thus it is suitable for everyone. Therefore, the existing statistical traffic information DB 107 may be overwritten and renewed. When the statistical traffic information is received from the traffic information center 11, it is considered that the data amount is huge if the data across the country is targeted. Therefore, the data amount may be reduced by downloading only the data about links on a route managed by the route information managing PART 102 or all the links contained in a secondary mesh containing the links on the route.

The prediction result outputting unit 109 has a function of subjecting the statistical data or information of the predicted arrival time, etc., calculated in the prediction data base to the format-conversion in connection with output means such as a display device, a speaker or the like which is connected to the outside of the traffic information prediction apparatus 10, and outputting the conversion result.

Next, the construction of a car navigation terminal which is an example of the traffic information prediction apparatus, 10 of the present invention will be described with reference to FIG. 11. A navigation terminal is provided with a display device 140, a GPS receiver 141, a cellular phone 144, a microphone 147 and a speaker 148 connected to the main body 142. The main body 142 is equipped with a memory card slot 143 or a media drive such as a DVD-ROM 149 drive or the like. Furthermore, a remote controller 145 for operating the main body 142 is provided.

The display device 140 is a device such as a liquid crystal screen or the like, and it can display a map screen and graphics of prediction information, etc., calculated in the traffic information predicting part 1080. The GPS receiver 141 receives positioning signals from a plurality of GPS satellites 146 and calculates the accurate position of the device. The main body 142 contains a CPU, a memory, a power source and a graphics display device, etc., therein. The details thereof will be described later with reference to FIG. 12. The cellular phone 144 is a device for carrying out communications externally, that is, carrying out data transmission/reception to/from the traffic information center 11.

The remote controller 145 is a device for transmitting a user's desired operation to the navigation terminal through a button. Furthermore, it can transmit commands with voices by using the microphone 147. The speaker 148 is a device for outputting sounds for prediction information calculated in the traffic information predicting part 1080, assistance to the user in the navigation operation, beep sound for attention/alarm, etc.

The memory card slot 143 is connected to an outside storage medium which uses a non-volatile memory, a small-size hard disk or the like, represented by a memory card and used to accumulate reception data from the traffic information center 11 and route information preserved in the route information managing part 102, the differential information of the statistical traffic information DB 107, etc., and also load the information thus accumulated to the navigation terminal. The memory card slot 143 may be merely used as a storage device, or used as a communication interface or for authentication of user information to receive a broadcast. For example, when a vehicle having the navigation terminal mounted therein is shared by a plurality of users in a rental car shop or home/company, that is, when the vehicle (and the navigation terminal) is used by a plurality of users, a memory card in which authentication information is written is inserted in the memory card slot 143, whereby the user is allowed to use the navigation terminal, and it is also used to accumulate the running record of every user.

A DVD-ROM drive 149 has a function of reading out data from a DVD-ROM medium 160 in which the map DB 100 for map data, data needed for route search/guidance, etc., or default statistical traffic information DB 107 is stored. When the DVD-ROM medium is a read only medium such as CD-ROM or the like, the above data is stored in the DVD-ROM medium. However when it is a rewriting type medium such as CD–RW, DVD-RAM, DVD–RW, DVD+RW or the like, or a rewritable medium such as a hard disk, the running record DB 106, the information received from the traffic information center 11 or the differential information on the statistical traffic information DB 107 may be stored in addition to the above data, the accumulation information such as the route information preserved in the route information managing part 102 as in the case of the memory card. The reading drive 149 for reading out various kinds of media is required to be adapted to the type of media.

Figure 11:
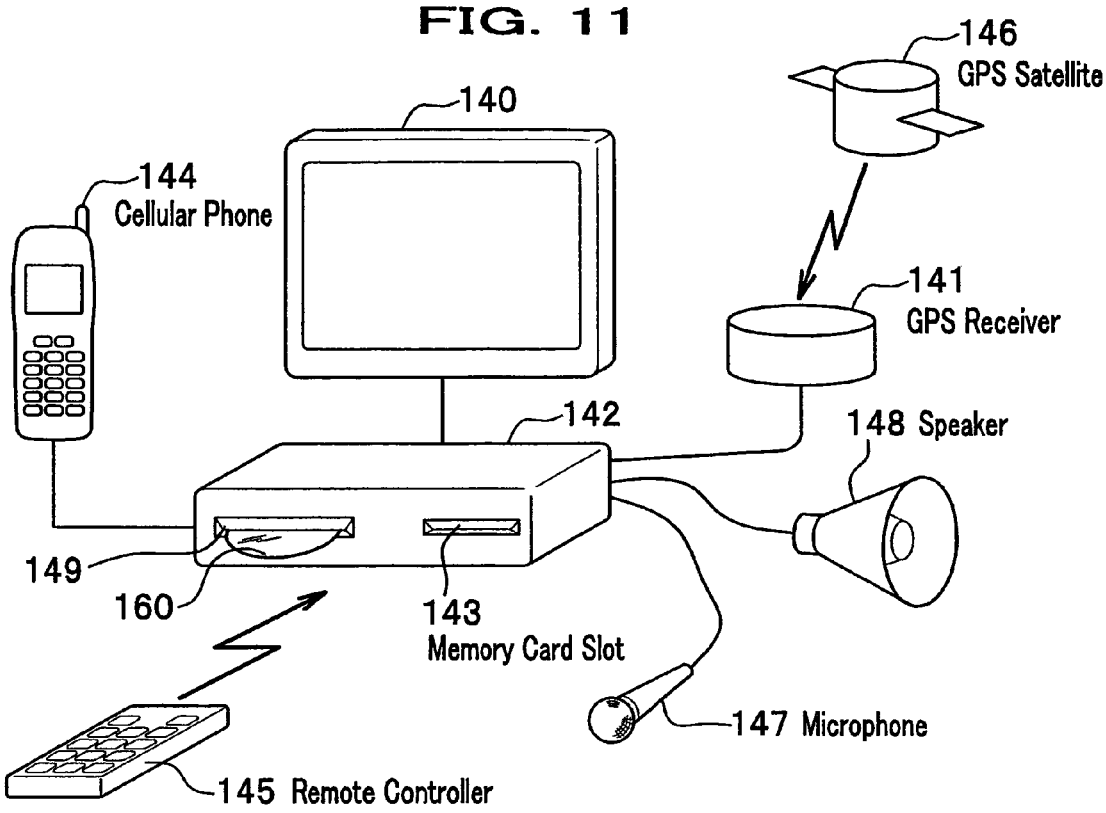
FIG. 11 is a diagram showing an example of the construction of a navigation terminal.

In the construction of FIG. 11, the cellular phone 144 is shown as communication equipment. However, the main body 142 may be equipped with a device having a wireless communication function such as PHS (Personal Handyphone System) Bluetooth, wireless LAN or DSRC (Dedicated Short Range Communication) terminal such as ETC or the like as other communication equipment, or a receiver which can receive broadcast electromagnetic waves from a satellite, broadcast electromagnetic waves using surface wave digital and broadcast electromagnetic waves using AM/FM electromagnetic waves, or a device for decoding received data may be provided to the main body 142. In place of the GPS receiver 141, a position identifying service using PHS or a cellular phone may be used. FIG. 11 shows a case where a navigation terminal is used as an example of the traffic information prediction apparatus 10. Particularly, the navigation main body 142, the display device 140, etc., may be replaced by a terminal having some degree display means and storage device such as PDA, note type personal computer, a cellular phone or the like.

Figure 12:
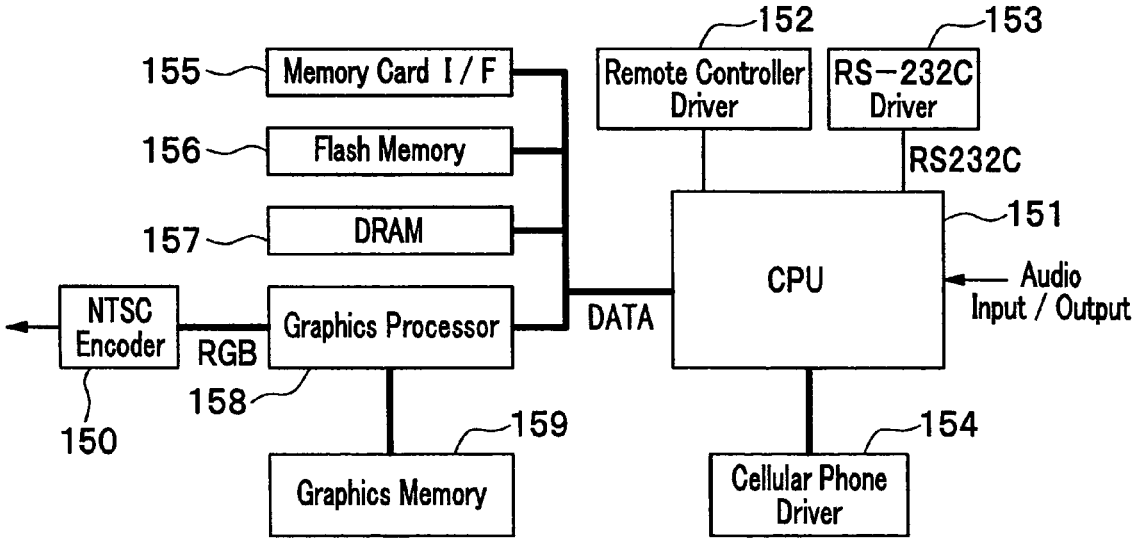
FIG. 12 is a diagram showing an example of a hardware construction of the navigation terminal.

FIG. 12 shows an example of the hardware construction of the main body 142 of the navigation terminal. In this embodiment, the main body 142 comprises CPU 151, a remote controller driver 152 for interpreting signals, from the remote controller 145, an RS-232C driver 153, a cellular phone driver 154, a memory card interface; 155 of the memory card slot 143, a flash memory 156, DRAM 157, a graphics processor 158, a graphics memory 159, and an NTSC encoder 150. The audio input/output is used for input from the microphone 147 for voice recognition and a voice guide output to the speaker 148.

The traffic information center 11 corresponds to an institution for collecting/distributing wide area traffic information such as JARTIC (Japan Road Traffic Information Center), the VICS center or the like, or a general business owner for receiving traffic information from the institution, and transmits/receives traffic information data to/from the traffic information prediction apparatus 10. In response to a request from the user of the traffic information prediction apparatus 10, the traffic information center 11 transmits real-time traffic information or statistical traffic information DB to the traffic information prediction apparatus 10. Conversely, it may receive accumulated running record DB 106 from the traffic information prediction apparatus 10 and use it to correct the statistical traffic information DB preserved in the traffic information center 11. When the data are transmitted/received, management of users may be carried out, that is, the traffic information center 11 may carry out user authentication by collating a pre-registered user ID and a password to specify the user for the authentication and carries out the monetary charge to the data receiving side. Accordingly, when the user of the traffic information prediction apparatus 10 downloads data from the traffic information center 11, a change occurs. On the other hand, when the user uploads the running record DB 105, he/she can obtain proceeds. The charging amount may be determined by the data amount (data size) or a transmission/reception frequency, for example.

Figure 13:
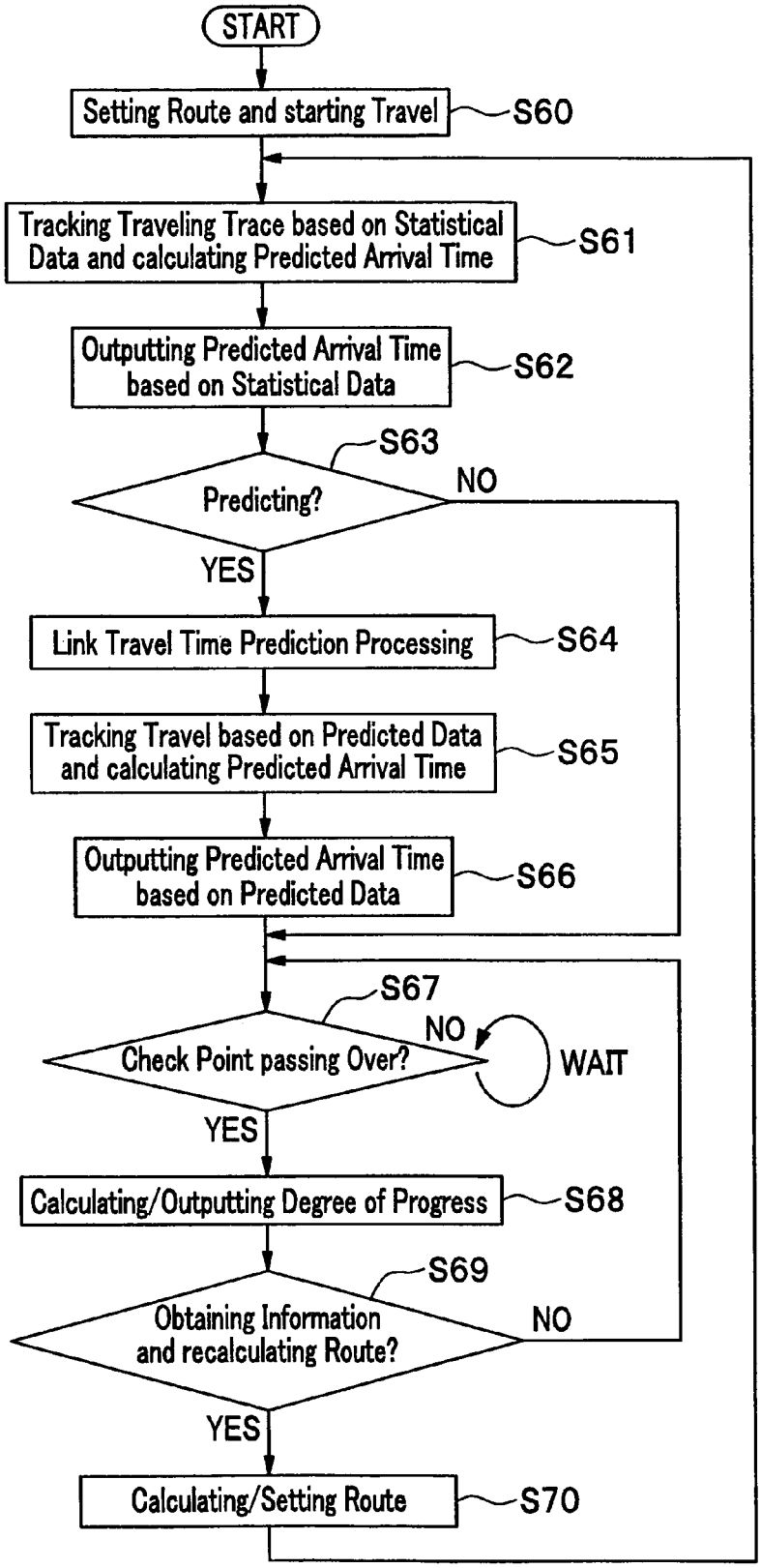
FIG. 13 is a flow chart showing an example along a usage situation using the traffic information prediction apparatus.
Figure 14:
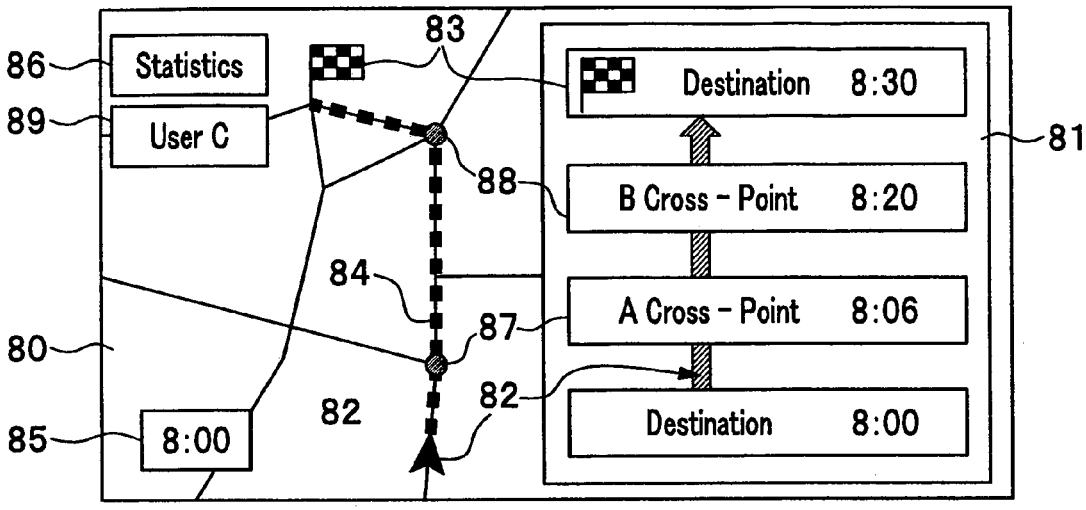
FIG. 14 shows an example of an output to a display device after departure.

Next, an example of a use style of the traffic information prediction apparatus 10 of the present invention will be described with reference to the flow chart of FIG. 13. First, a user sets a destination and a route by using the route searching function of the route searching part 101, and starts to drive a vehicle (S60). Data about all the links contained in the route thus set is obtained from the statistical traffic information DB 107 as in the case of S50 and S51, and the traveling trace based on the statistical data and predicted arrival times to the destination and check points such as main cross-points, etc., on the route (S61), and outputs the predicted arrival time to the destination to the display device 140 or the speaker 148 (S62). FIG. 14 shows an output example to the display device just after departure (8:00). In FIG. 14, reference numeral 80 denotes a map drawing area, reference numeral 81 denotes a route schematic diagram drawing area, reference numeral 82 denotes a current place, reference numeral 83 denotes a destination, reference numeral 84 denotes a route, reference numeral 85 denotes a current time achievable from GPS, reference numeral 86 denotes the type of data which is original data for calculating the predicted arrival time, reference numerals 87 and 88 denote a cross-point A and a cross-point B which correspond to check points, and reference numeral 89 denotes user ID (or registered user name) identified by the user identifying part 104. Furthermore, as an output to the speaker 148, information displayed on the route schematic diagram drawing area 81 may be output with voices.

Figure 15:
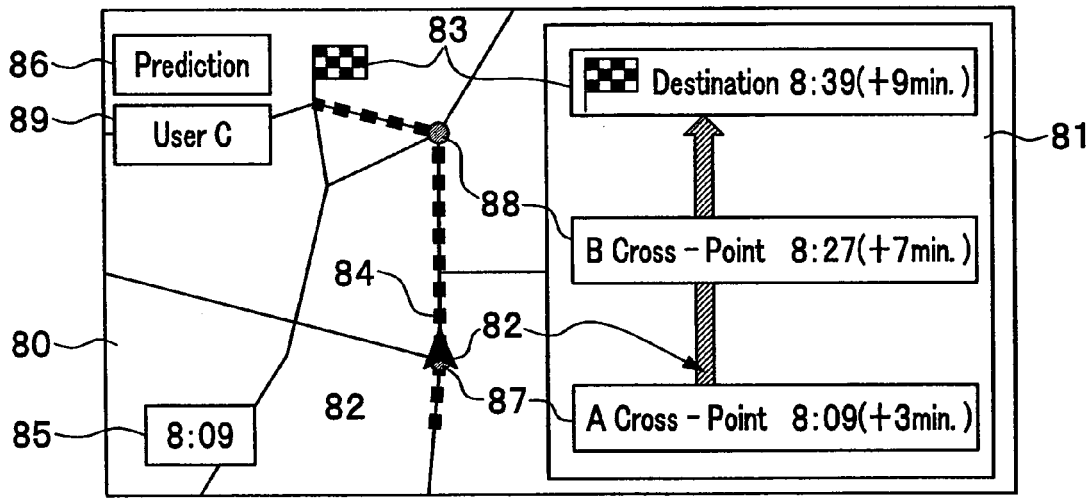
FIG. 15 shows an example of an output to the display device after the prediction processing or after the vehicle passes over a check point.
Figure 16:
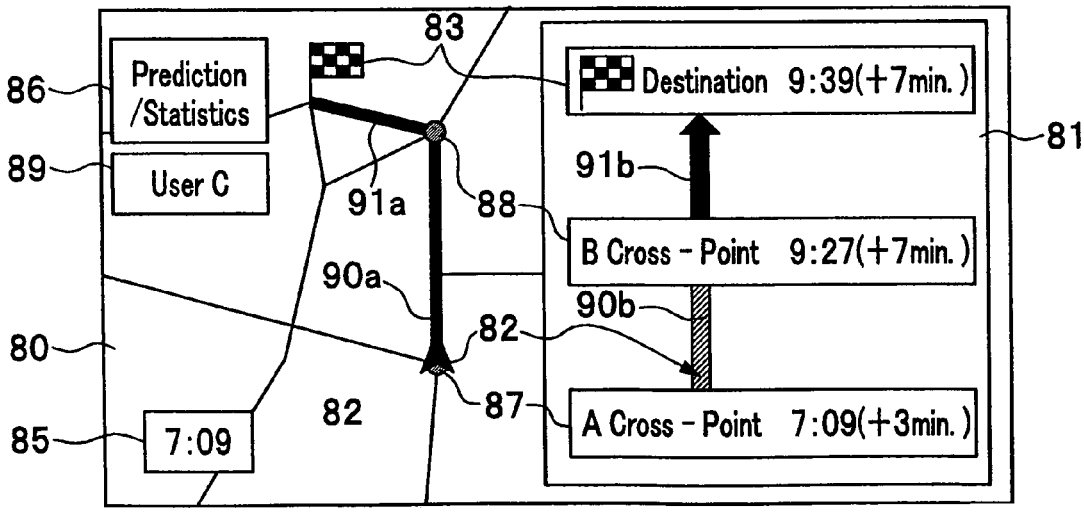
FIG. 16 shows an example of an output of a data type to the display device after the prediction processing or after the vehicle passes over a check point.

During running, it is judged whether prediction should be carried out or not as in the case of S52 (S63). If the prediction is carried out (YES in S63), a near future travel time predicted value of each link is calculated (S64) as in the case of S53, the traveling trace based on the predicted data and the predicted arrival times to the destination and the check points, etc., are calculated (S65), and the predicted arrival times to the destination and the check points are output to the display device 140 or the speaker 148 (S66). FIG. 15 shows an example of the output of a prediction result to the display device when the time (8:09) at which the current position of the vehicle passes over the A cross-point corresponds to the timing of the prediction. In FIG. 15, the predicted arrival time 87 to the A cross-point is corrected to 8:09, and further a display of "+3" which denotes a delay of 3 minutes from the initial predicted arrival time of 8:06 is added as the degree of progress. Conversely, when the arrival time at the A cross-point is advanced further by 3 minutes than the initial predicted arrival time, "–3 minutes" is displayed. The predicted arrival times to a B cross-point 88 and a destination 83 which are obtained by calculating the traveling trace based on the travel time prediction of a subsequent link to the current position 82 on the route and the predicted data are corrected by using the degree of progress which is calculated from the statistical data Th and the actually recorded data Th' on the travel time from the departure place to the A cross-point, and a display of the degree of progress is also added. The display of the type 86 of the data corresponding to the original data for the calculation of the predicted arrival times is changed from "statistics" to "prediction". As an output to the speaker 148, for example, a voice of "vehicle is behind schedule and will arrive after a delay of 9 minutes" may be output to the speaker 148. If a destination ahead of the B cross-point is out of the prediction target because the destination is far, the traveling trace based on any one of the statistical data and the predicted data is calculated for each link, and it may be clarified which one of these data is used for the calculation in each link as shown in FIG. 16. In FIG. 16, reference numerals 90 and 91 denote that links are calculated on the basis of the predicted data and the statistical data, respectively, and also denote that the type 86 of the data corresponding to the original data for the calculation of the predicted arrival time uses both of "prediction/statistics".

By using the position information of GPS and the route information preserved in the route information managing part 102, it is judged during travel whether the vehicle passes over the check point (B cross-point) (S67). If the vehicle passes over the check point (YES in S67), the degree of progress is calculated, and then the predicted arrival times to the destination and the check points are calculated by using the predicted data thus obtained and output to the display device 140 or the speaker 148 (S68). When the latest predicted arrival time to the destination is different from the predicted arrival time based on the initial statistical data by a predetermined time or more (the degree of progress is out of a predetermined range), the user is notified of the fact that there is a great difference therebetween, and then it, is inquired whether a re-search should be carried out or not (S69). If a route is re-searched (YES in S69), the user is prompted to select whether he/she uses the statistical traffic information DB 107 or the real-time traffic information achievable from the traffic information center 11. On the basis of this selection, the route searching is carried out and newly set route information is registered in the route information managing part 102 (S70).

Subsequently, the processing from the step S61 to the step S70 are successively repeated until the vehicle arrives at the destination, a predetermined time or more elapses or the service of the route guidance is finished by the user. When the real-time traffic information is used in S70, the real-time traffic information may be used to calculate subsequent predicted arrival times.

With respect to some routes, the degree of progress and the predicted arrival time may be excessively frequently renewed/output to the user because the number of check points is excessively large, which adversely affects the safe driving. In order to avoid such a situation, some of check points may be properly thinned out when the check point appears frequently. The following method may be used as a thin-out method. That is, a checkpoint which appears first is set as a standard point, check points located within a predetermined distance from the standard point are removed, and a next check point is set. Subsequently, this process is repeated to successively settle a next check point while removing check points located within a predetermined distance from the previously settled check point in the same manner as described above. The predetermined distance may be set to a different value between the general road and the express highway in consideration of the distance by which the vehicle can run per time unit, or it may be set by the user's input operation. Another thin-out method described below may be used. That is, priorities in the scale of cross-points, etc., are preset to the respective check points in advance, and other check points than check points having high priorities are thinned out. There may be considered such a case that the user cannot check the progress condition because of an excessively small number of check points with respect to some routes. In this case, it is necessary to regard places other than the pre-registered check points as new check points. Specifically, new check points are set every predetermined distance on a route with the departure place as a standard. The predetermined distance may be set to be different between the general roads and the express highway in consideration of the distance by which the vehicle can run per unit time, or it may be set by user's input operation.

As described above, the predicted arrival time based on the statistical data is displayed at the start time when the vehicle starts to run, and this display is switched to a display of the predicted arrival time based on the predicted data at the time when some degree of the running record is accumulated, whereby the predicted arrival time can be offered to the user at all times and the prediction precision can be enhanced in connection with the running of the vehicle. Furthermore, the user is prompted to carry out a re-search of a route when the progress condition is greatly different from the arrival prediction based on the initial statistical data, and thus a re-search and obtainment of real-time traffic information can be carried out only as occasion demands. Therefore, the user's operation amount and the cost associated with the data communications can be suppressed to the minimum level, and thus user-friendliness is enhanced.

It is a matter of course that various modifications can be made without departing from the gist of the present invention.

What is claimed is:

1. A traffic information prediction apparatus that has a function for predicting an arrival time at a destination, comprising:

map data containing road data;

a route searching means for searching a travel route from a current place to the destination on the basis of the map data;

statistical traffic information obtained by statistical processing past accumulated traffic information;

a travel status measuring means for measuring a travel status of a vehicle and accumulating the travel status of the vehicle thus measured as travel record information;

a traffic information predicting means for predicting traffic information on a searched route on the basis of the travel record information and the statistical traffic information to predict arrival time at any place on the route containing the destination; and a prediction result outputting means for outputting a prediction result, wherein the traffic information predicting means compares a traveling trace based on the statistical traffic information on the searched route from a departure to the destination and a traveling trace based on the travel record information to calculate a degree of progress of the travel record to the statistical traffic information, and corrects the traveling trace based on the statistical traffic information from the current place to the destination on the basis of the degree of progress to predict an arrival time at a representative point including the destination on the travel route.

2. The traffic information prediction apparatus according to claim 1, wherein the traffic information predicting means judges whether prediction should be carried out in accordance with the degree of progress or not, and predicts the arrival time by using the traveling trace based on the statistical traffic.

3. The traffic information prediction apparatus according to claim 1, further comprising prediction result outputting means for outputting a prediction result, wherein the prediction result outputting means outputs the degree of progress along with a passing time or an arrival time of a passing point or a destination which is predicted in the traffic information predicting means.

4. The traffic information prediction apparatus according to claim 1, further comprising;

a means for transmitting/receiving data to/from the outside, route searching means for searching a route to the destination, a route searching means for searching a route to a destination, and a prediction result outputting means for outputting a prediction result, wherein when the degree of progress is out of the predetermined range in the traffic information predicting means, the traffic information predicting means notifies this fact to the user, and further the traffic information predicting means allow the user to obtain traffic information from an outside institution such as a traffic information center or the like and input whether a re-search of a route is carried out or not, and downloads traffic information from the outside institution to carry out the research of the route by using the traffic information in the route searching means when it is determined that the re-searching is carried out.

5. A traffic information prediction, that has a function for predicting an arrival time at a destination, comprising:

map data containing road data;

a route searching means for searching a travel route from a current place to the destination on the basis of the map data;

statistical traffic information obtained by statistical processing past accumulated traffic information;

a travel status measuring means for measuring a travel status of a vehicle and accumulating the travel status of the vehicle thus measured as travel record information;

a traffic information predicting means for predicting traffic information on a searched route on the basis of the travel record information and the statistical traffic information to predict arrival time at any place on the route containing the destination; and a prediction result outputting means for outputting a prediction result, further comprising user identifying means for identifying/setting a user of a running vehicle, wherein the travel record information accumulated in the travel status measuring means is discriminated for every user, and the travel record information used in the traffic information predicting means is travel record information of each user.

6. The traffic information prediction apparatus, that has a function for predicting an arrival time at a destination, comprising:

map data containing road data;

a route searching means for searching a travel route from a current place to the destination on the basis of the map data;

statistical traffic information obtained by statistical processing past accumulated traffic information;

a travel status measuring means for measuring a travel status of a vehicle and accumulating the travel status of the vehicle thus measured as travel record information;

a traffic information predicting means for predicting traffic information on a searched route on the basis of the travel record information and the statistical traffic information to predict arrival time at any place on the route containing the destination; and a prediction result outputting means for outputting a prediction result, further comprising statistical traffic information correcting means for correcting the statistical traffic information on the basis of the travel record information.

7. The traffic information prediction apparatus according to claim 6, further comprising means for transmitting/receiving data to/from the outside, wherein the means downloads statistical traffic information from an outside institution such as a traffic information center or the like, and renews the statistical traffic information on the basis of the statistical traffic information thus downloaded by the statistical traffic information correcting means.

8. The traffic information prediction apparatus that has a function for predicting an arrival time at a destination, comprising:

map data containing road data;

a route searching means for searching a travel route from a current place to the destination on the basis of the map data;

statistical traffic information obtained by statistical processing past accumulated traffic information;

a travel status measuring means for measuring a travel status of a vehicle and accumulating the travel status of the vehicle thus measured as travel record information;

a traffic information predicting means for predicting traffic information on a searched route on the basis of the travel record information and the statistical traffic information to predict arrival time at any place on the route containing the destination; and a prediction result outputting means for outputting a prediction result, further comprising means for transmitting/receiving data to/from the outside, wherein the means uploads the travel record information to an outside institution such as a traffic information center or the like, and carries out monetary charge to the outside institution.

* * * * *